US009441857B2

(12) United States Patent
Qiu et al.

(10) Patent No.: US 9,441,857 B2
(45) Date of Patent: Sep. 13, 2016

(54) LOW-NOISE, GAS-TYPE, INSTANTANEOUS WATER HEATER

(71) Applicant: A. O. Smith Corporation, Milwaukee, WI (US)

(72) Inventors: Bu Qiu, Nanjing (CN); Dayan Bi, Nanjing (CN); Ya Zhao, Nanjing (CN)

(73) Assignee: A. O. SMITH CORPORATION, Milwaukee, WI (US)

( * ) Notice: Subject to any disclaimer, the term of this patent is extended or adjusted under 35 U.S.C. 154(b) by 73 days.

(21) Appl. No.: 14/380,834

(22) PCT Filed: Dec. 27, 2012

(86) PCT No.: PCT/CN2012/087672

§ 371 (c)(1),
(2) Date: Dec. 1, 2014

(87) PCT Pub. No.: WO2013/127242

PCT Pub. Date: Sep. 6, 2013

(65) Prior Publication Data

US 2015/0090200 A1 Apr. 2, 2015

(30) Foreign Application Priority Data

Mar. 1, 2012 (CN) ..... 2012 1 0051343

(51) Int. Cl.
*F22B 27/00* (2006.01)
*F24H 1/14* (2006.01)
*F24H 9/20* (2006.01)

(52) U.S. Cl.
CPC ..... *F24H 1/145* (2013.01); *F24H 9/2035* (2013.01)

(58) Field of Classification Search
CPC ..... F23J 2900/13003; F24H 9/2035; Y02B 30/745; F24D 19/1012
USPC ..... 122/40
See application file for complete search history.

(56) References Cited

U.S. PATENT DOCUMENTS 5,255,665 A * 10/1993 Windon ..... F23L 17/005 122/18.31
5,357,907 A * 10/1994 Moore, Jr. ..... F24H 1/206 122/14.22
2010/0111508 A1* 5/2010 Ding ..... F24D 3/08 392/308

(Continued)

FOREIGN PATENT DOCUMENTS

CN 2335093 8/1999
CN 2366766 3/2000

(Continued)

OTHER PUBLICATIONS

International Search Report for International Application No. PCT/CN2012/087672 dated Apr. 4, 2013 (6 pages).

*Primary Examiner* — Gregory A Wilson
(74) *Attorney, Agent, or Firm* — Michael Best & Friedrich LLP

(57) ABSTRACT

The invention relates to a low-noise gas instantaneous water heater, belonging to the technical field of gas appliances. The low-noise gas instantaneous water heater comprises a combustion device, a heat exchanger and a blower; wherein the combustion device, the heat exchanger and the blower are arranged such that a combustion flue gas is discharged after passing sequentially through the heat exchanger and the blower; the blower comprises a stepless speed regulating motor with a motor control panel and an impeller driven by the motor, and at least one thermal insulation device is arranged between the motor control panel and the combustion flue gas generated by the combustion device. The low-noise gas instantaneous water heater is capable of combining the advantages of an updraught structure and a stepless speed regulating blower, effectively solving the problem of loud noise in the operation process of the heater, and reaching the requirements of the constant temperature performance, exhaust gas indexes and reliability of the gas instantaneous water heater.

9 Claims, 3 Drawing Sheets

(56) References Cited

U.S. PATENT DOCUMENTS

2011/0308481 A1* 12/2011 Gordon ..... F23L 11/02
122/18.1
2012/0125268 A1* 5/2012 Huang ..... F23N 5/242
122/14.1
2012/0192813 A1* 8/2012 Evans ..... F28D 7/024
122/20 B
2012/0291719 A1* 11/2012 Steinhafel ..... F24H 1/00
122/18.3
2013/0069467 A1* 3/2013 Smith ..... H02K 1/182
310/156.08

FOREIGN PATENT DOCUMENTS

| | | |
|---|---|---|
| CN | 101303161 | 7/2010 |
| CN | 102538174 | 7/2012 |
| CN | 202532690 | 11/2012 |
| JP | S63154797 | 10/1988 |
| JP | H08100798 | 4/1996 |

* cited by examiner

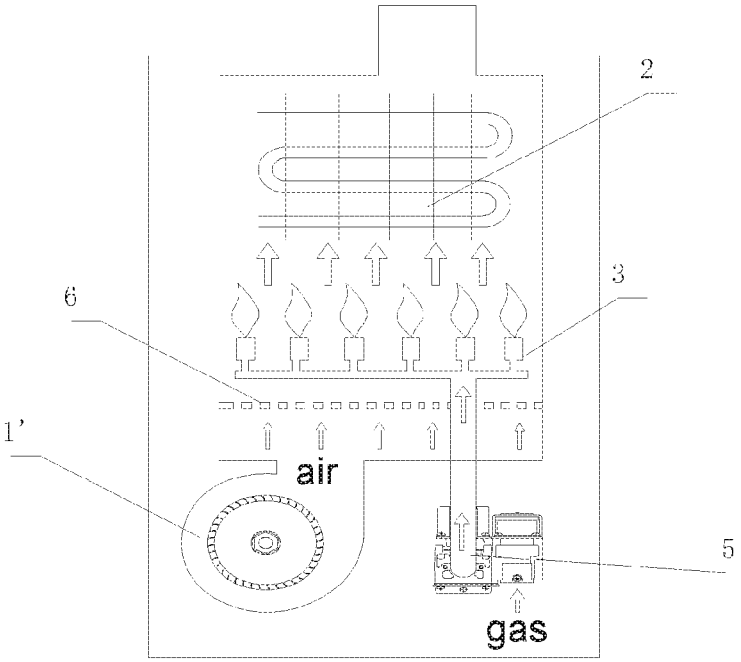
Prior Art Fig. 1
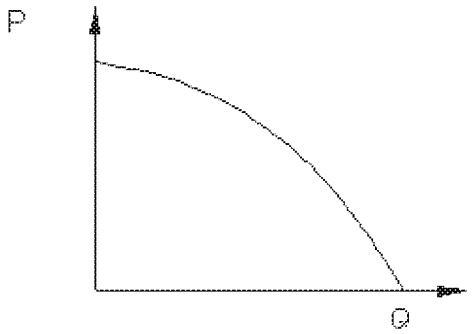
Fig. 2
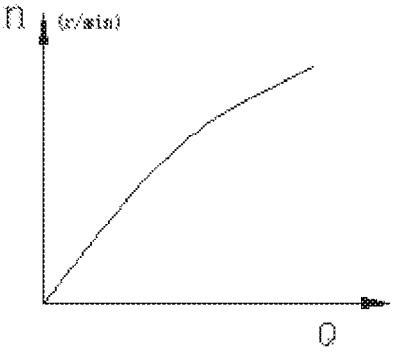
Fig. 3

LOW-NOISE, GAS-TYPE, INSTANTANEOUS WATER HEATER

FIELD OF THE INVENTION

The present invention relates to a water heater, and particularly to a low-noise gas instantaneous water heater, belonging to the technical field of gas appliances.

BACKGROUND OF THE INVENTION

An existing gas instantaneous water heater (as shown in FIG. 1) adopts a downward air-blasting blower 1' to provide the air required for combustion, and the blower 1' is mounted at the bottom of a combustion chamber. A combustion device 3 is arranged in the combustion chamber, and an air uniformizing board 6 is provided between an air outlet of the blower 1' and the combustion device. Gas passes sequentially through a gas proportional valve 5 and the combustion device 3, and is in combustion at the top of the combustion device 3. The air provided by the blower 1' passes sequentially through the blower 1', the air uniformizing board 6 and the combustion device 3, and supports the combustion at the top of the combustion device 3. The air uniformizing board 6 sends out the air provided by the blower 1' uniformly by passing through the whole air uniformizing board 6 via tiny through holes distributed thereon.

Researches show that the tiny through holes on the air uniformizing board 6 generates a relatively large resistance to the air provided by the blower 1', which results in a relatively large pressure difference formed at the front and back of the air uniformizing board 6 and a relatively large pressure space formed between the air outlet of the blower 1' and the air uniformizing board 6. In the case of same rotating speed, pressure P and air quantity Q at the air outlet of the blower 1' are in an inversely proportional relationship (as shown in FIG. 2). In the case of same pressure at the air outlet of the blower 1', air quantity Q of the blower 1' is in direct proportion to rotating speed n of the blower (as shown in FIG. 3). Therefore it is required to improve the rotating speed of the blower 1' to overcome the resistance at the air outlet of the blower 1' so as to provide an amount of air required for combustion in the case of a relatively large pressure of the air outlet of the blower 1' caused by the air uniformizing board 6. Theories and tests prove that the noise in operation of the blower 1' is a main source of the noise of the gas instantaneous water heater, and the noise level is in direct proportion to square of the rotating speed. Therefore a downward air-blasting gas water heater produces relatively large noise during operation.

Chinese Utility Model patent Application No. 201020151828.4 discloses an updraught gas instantaneous water heater, wherein a heat exchanger is arranged on the upper part of the combustion device, a blower is arranged above the heat exchanger and provides an amount of air required for combustion for the combustion device by air draught. The inside of the combustion chamber is in a state of negative pressure all the time, and air flow field in the vicinity of the combustion device is relatively uniform with respect to that of a downward air-blasting structure. Therefore, there is no need to adjust the uniformity of the air by utilizing an air uniformizing board, thereby avoiding a high pressure area formed by the pressure difference caused by the adoption of the air uniformizing board. It can be seen from FIGS. 2 and 3 that a relatively low rotating speed of the blower could provide the amount of air for maintaining the combustion, thereby the noise generated during the operation of the heater could be suppressed.

However, in the updraught structure, the high temperature combustion flue gas (about 150 Celsius degree) is discharged by passing through an impeller of the blower, which has a relatively high requirement to heat resistance of the blower. The technical solution of the above patent can merely adopt a blower driven by an alternating current motor, for the reason that there is no need for a motor control panel, and the rest parts are all made of metal material which is capable of resisting high temperature up to 150 degree.

However, in the operation of the gas water heater, besides consideration of noise, it is also needed to regulate and control the blower according to actual combustion requirement to convey reasonable air amount, so as to sufficiently burn the gas while guarantee the required combustion temperature, so that the combustion is reliable and exhaust emission reaches the standard. An existing blower driven by the alternating current motor can rotate at only several limited numbers of rotating speed, therefore it is very difficult to achieve accurate control of the rotating speed of the blower and consequently popularization and application of the above patent technology is restricted.

SUMMARY OF THE INVENTION

The invention is aimed to provide a low-noise gas instantaneous water heater which can effectively reduce the noise while guaranteeing a reliable combustion and up-to-standard emission.

A feasible technical solution for realizing the reliable combustion and up-to-standard emission adopts a stepless speed regulating direct current motor such as a direct current brushless blower and the like, such that a rotating speed of the blower can be regulated and controlled as required so as to accurately provide an amount of air required for combustion. However, such a direct current motor necessarily comprises a motor control panel of which some components have a limited temperature resistance. Therefore, if such a direct current motor is applied directly to drive an updraught blower with low noise, it will be inevitably damaged due to a high temperature generated by the combustion flue gas.

To achieve the above object, the low-noise gas instantaneous water heater of the invention comprises a combustion device, a heat exchanger and a blower; wherein the combustion device, the heat exchanger and the blower are arranged such that a combustion flue gas is discharged after sequentially passing through the heat exchanger and the blower; the blower comprises a stepless speed regulating motor with a motor control panel and an impeller driven by the motor, and at least one thermal insulation device is arranged between the motor control panel and the combustion flue gas generated by the combustion device.

Since the low-noise gas instantaneous water heater of the invention is particularly provided with a thermal insulation device which can prevent the motor control panel to be damaged due to the high temperature generated by the combustion flue gas passing through the impeller of the blower, the problem that the stepless speed regulating blower comprising the motor control panel is unable to resist high temperature is solved. Consequently, the stepless speed regulating blower can be applied to the updraught gas instantaneous water heater, and thus the advantages of the updraught gas instantaneous water heater could be utilized. It is needless to adjust uniformity of the air via an air uniformizing board, and a relatively high pressure area formed due to a relatively large pressure difference at the front and back of the air uniformizing board is avoided. The resistance encountered by the air and combustion flue gas inside the system is relatively small, and during combustion the interfusion of a secondary air is dominated by the expansion of the combustion boundary, which is different from an air-blasting system in which the secondary air participates into the combustion by initiatively stirring flame boundary surface. Due to self-rising wind force generated during combustion, the flame has functions of injection and traction to suction of the air, thus it can be said that flow velocity of the flame airflow is higher than that of the secondary air flowing along the flame boundary. The airflow velocity of the secondary air far away from the flame boundary will decrease with the increasing of the distance. Due to the requirements of downward air-blasting combustion to maintain pressure in the combustion chamber and mix uniformized intake air flow into combustion flame, blowing of the secondary air substantially maintains a horizontal velocity face, therefore an amount of air passes through the air-blasting system obviously larger than that passes through an air-draught system in the case of same cross-sectional area. Therefore the two combustion systems have the characteristics that the downward air-blasting combustion is mainly turbulent combustion, and the updraught combustion is mainly transition flow combustion. Total amount of air entering into the combustion chamber and generated by such supply mode of the secondary air will have a greater difference if the combustion load in the air-draught system is relatively small. In this way the amount of air for maintaining small load combustion of the system becomes less obvious, that is, the combustion can be maintained only at a smaller rotating speed of the blower than that of the air-blasting system, thereby reducing the noise of the blower and of the whole heater.

A further improvement of the invention lies in that, a gas proportional valve is arranged in an air supply pipeline of the combustion device, a signal output end of the gas proportional valve is connected to a master controller, and a control signal output end of the master controller is connected to the motor control panel.

In this way, during the operation of the heater, the master controller receives a current signal of the gas proportional valve and calculates an amount of air required for combustion according to the received signal which afterwards is converted into a command signal for the rotating speed of the blower. The motor control panel of the blower adjusts the rotating speed of the blower according to the command signal from the master controller to accurately provide the amount of air required for combustion. The rotating speed of the blower is adjusted steplessly and accurately according to a gas flow by the stepless speed regulating blower. Combining with the advantage of small loss of pressure in the combustion chamber of the updraught gas instantaneous water heater, it can be seen that the rotating speed of the blower of the low-noise gas instantaneous water heater of the invention decreases significantly relative to the downward air-blasting gas instantaneous water heater in the same combustion state. In addition, since the low-noise gas instantaneous water heater of the invention can correspondingly adjust the rotating speed of the blower according to the gas flow supplied by the proportional valve to accurately provide the amount of air required for combustion, the mixing ratio of the gas and air is in an optimum state all the time. The low-noise gas instantaneous water heater has great improvements on constant temperature performance, exhaust gas indexes and reliability of the gas instantaneous water heater, thereby giving full play to the advantage of stepless speed regulation of the blower.

Another further improvement of the invention lies in that, the combustion device comprises at least two sets of controllable combustors in which a combustion can occur separately or simultaneously.

A user does not use a large water flow for every time in the process of use, for example, water flow required for use in the kitchen is relatively small, and thus the gas instantaneous water heater can operate with only a relatively small load. The operation load of the gas instantaneous water heater can be regulated flexibly in a wide scope by the operation of partial set(s) or all sets of the combustors and by the regulation of the gas flow via the proportional valve, so as to better meet different water demand of users. In the case that only partial set(s) of the combustors are in operation, the gas flow in combustion decreases, and the amount of air required for the combustion decreases correspondingly. Moreover, the cross section on which a combustion flame of the updraught system functions by injecting the secondary air becomes smaller, and the amount of air passing through the updraught system becomes smaller than that of the air-blasting system. Moreover in such case, the low-noise gas instantaneous water heater of the invention accurately reduces the rotating speed of the stepless speed regulating blower according to the amount of air required for combustion, so as to further reduce the noise in the operation of the gas instantaneous water heater. In the case that the combustor sets are in combustion in different combination modes, a combustion load area of each combination mode varies due to different numbers of the combustors, but the noise areas corresponding to the combustion load areas of each of the combination modes are substantially the same, combustion load areas corresponding to low-noise areas in different combination modes are adopted to constitute a continuous low-noise combustion load area of the gas instantaneous water heater, so that the noise in operation of the gas instantaneous water heater in the low-noise combustion load area is maintained within a very low range of noise, and the user is free from the noise due to the operation of the gas instantaneous water heater when using water in the kitchen, thereby achieving an unexpected effect.

Other improvements of the invention are as below.

The thermal insulation device is arranged between the impeller and the motor control panel, so that the heat generated by the combustion flue gas passing through the impeller are isolated from the motor control panel by the thermal insulation device and thus the damage to the motor control panel could be avoided.

The thermal insulation device comprises at least one thermal insulation plate arranged on a shell of the blower with a thermal insulation gap provided therebetween.

A heat dissipation fan is arranged between the thermal insulation device and the motor control panel.

A stator and a rotor of the stepless speed regulating motor are arranged between the thermal insulation device and the motor control panel.

The combustion flue gas of the combustion device enters an air intake of the blower in a direction along which the combustion flue gas flows out of the heat exchanger.

The thermal insulation device comprises at least one thermal insulation plate arranged on a shell of the blower and fixedly connected with a fixing plate, and a thermal insulation gap is provided between the fixing plate and the thermal insulation plate.

In conclusion, the invention can combine the advantages of an updraught structure and the stepless speed regulating blower, which effectively solves the problem of loud noise in the operation process of the heater and reaches the requirements of constant temperature performance, exhaust gas indexes and reliability of the gas instantaneous water heater.

BRIEF DESCRIPTION OF THE DRAWINGS

Hereinafter the invention will be further described by referring to the accompanying drawings.

FIG. 1 is a structural diagram of an existing downward air-blasting gas instantaneous water heater, wherein: 1'—blower, 2—heat exchanger, 3—combustion device, 5—gas proportional valve, 6—air uniformizing board.

FIG. 2 is a graph of relationship between pressure at an air outlet of the blower and an amount of air in the case of same rotating speed.

FIG. 3 is a graph of relationship between the amount of air of the blower and rotating speed of the blower in the case of same pressure.

DETAILED DESCRIPTION OF THE EMBODIMENTS

Embodiment 1

Figure 4:
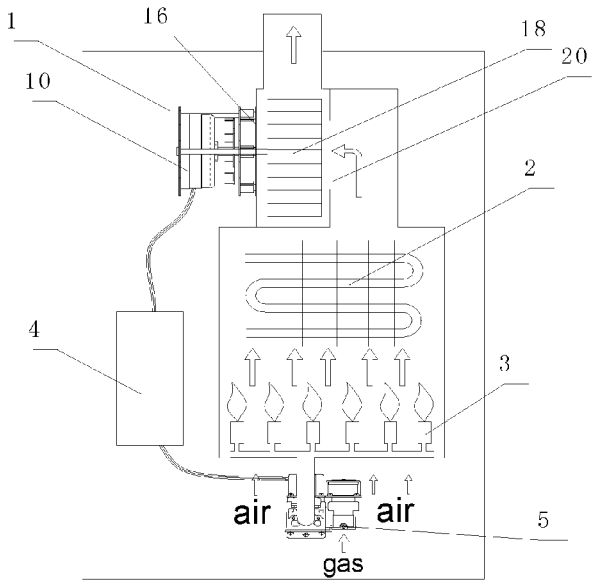
FIG. 4 is a structural diagram of a whole heater according to embodiment 1 of the invention, wherein: 1—blower, 2—heat exchanger, 3—combustion device, 4—master controller, 5—gas proportional valve, 10—motor control panel, 16—thermal insulation plate, 18—impeller, 20—air intake.
Figure 6:
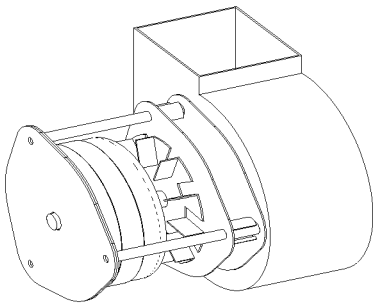
FIG. 6 is a perspective view of the blower according to embodiment 1 of the invention.
Figure 7:
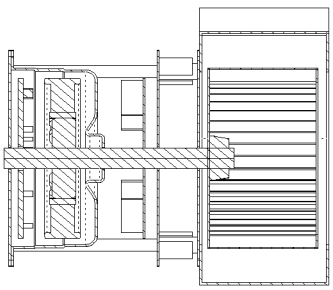
FIG. 7 is a sectional view of the blower according to embodiment 1 of the invention.
Figure 8:
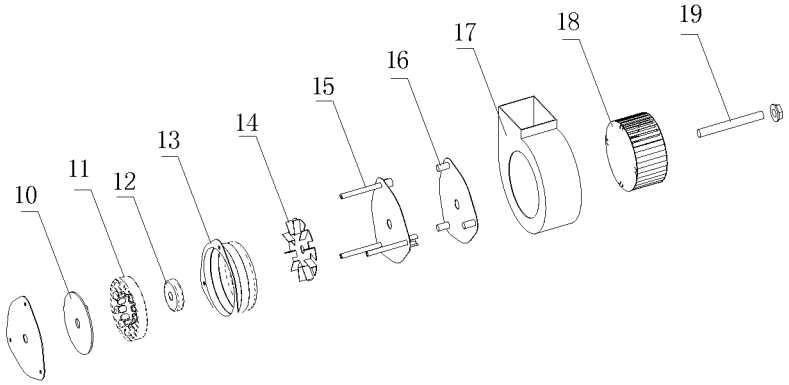
FIG. 8 is an exploded view of the blower according to embodiment 1 of the invention, wherein: 10—motor control panel, 11—stator, 12—rotor, 13—motor housing, 14—heat dissipation fan, 15—fixing plate, 16—thermal insulation plate, 17—blower shell, 18—impeller, 19—shaft.

As shown in FIG. 4, a combustion device 3, a heat exchanger 2 and a blower 1 of a low-noise gas instantaneous water heater of the embodiment constitute the structure of an updraught gas instantaneous water heater. The combustion flue gas of the combustion device 3 is discharged after passing sequentially through the heat exchanger 2 and an impeller 18 of the blower 1. The specific structure of the blower is shown in FIGS. 6, 7 and 8. A motor control panel 10, a stator 11, a rotor 12 and a motor housing 13 form a direct current brushless motor. A shaft 19 is fixedly connected with the rotor 12, a heat dissipation fan 14 and the impeller 18. A blower shell 17 is arranged outside the impeller 18. A heat insulation plate 16 is arranged on the blower shell 17. A fixing plate 15 is fixedly connected with the heat insulation plate 16, and the motor housing 13 is fixed on the fixing plate 15. The low-noise gas instantaneous water heater further comprises a master controller 4 and a gas proportional valve 5. A signal output end of the gas proportional valve 5 is connected to a corresponding port of the master controller 4, and a control signal output end of the master controller 4 is connected to the motor control panel 10.

The blower shell 17 and the heat insulation plate 16 isolate the combustion flue gas passing through the impeller from the direct current brushless motor. A thermal insulation gap is provided between the fixing plate 15 and the thermal insulation plate 16. The thermal insulation gap and the fixing plate 15 further prevent the heat on the thermal insulation plate 16 from radiating. And the heat radiation on the fixing plate 15 is dissipated via the heat dissipation fan 14. Moreover, since the direct current brushless motor is disposed such that the stator 11 and the rotor 12 thereof are close to the impeller 18, and the motor control panel 10 thereof is away from the impeller 18, the purpose of preventing the damage to the direct current brushless motor control panel 10 due to high temperature generated by the combustion flue gas is achieved.

During the operation of the heater, the master controller 4 receives a current signal of the gas proportional valve 5 and calculates an amount of air required for combustion according to the received signal which afterwards is converted into a command signal for the rotating speed of the blower 1. The motor control panel 10 of the blower 1 adjusts the rotating speed of the blower 1 according to the command signal from the master controller 4 to accurately provide the amount of air required for combustion.

Upon experimental comparisons, it is found that the noise generated by the low-noise gas instantaneous water heater adopting the technical solution of the embodiment is lower by 10 dbs or more than that is generated by a downward air-blasting gas instantaneous water heater under the same condition. And the low-noise gas instantaneous water heater adopting the technical solution of the embodiment achieves a better noise reducing effect in the case of low-load operation.

Figure 9:
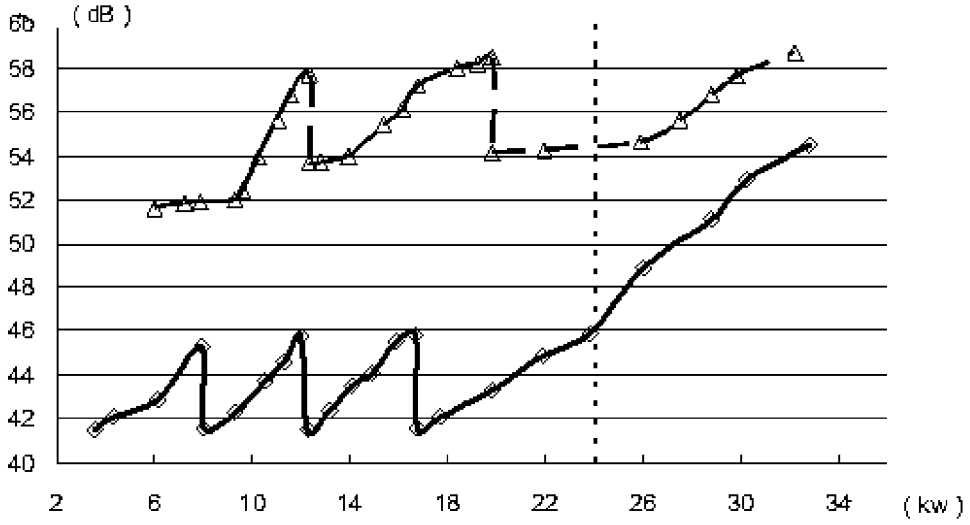
FIG. 9 is a curve test chart of relationship between load and noise according to embodiment 1 of the invention.

Upon contrasting the downward air-blasting gas instantaneous water heater with three stage combustion and the updraught gas instantaneous water heater with four stage combustion, a graph as shown in FIG. 9 is obtained in which an upper curve indicates a load noise of the downward air-blasting gas instantaneous water heater with three stage combustion and a lower curve indicates a load noise of the updraught gas instantaneous water heater with four stage combustion. With the increase of the load, noises in the upper and lower curves eventually tend to be the highest and the difference between the two noises is about 4 dbs. However, in an area of low load (for example, lower than the load indicated by the dashed line in FIG. 9), the noise of the updraught gas instantaneous water heater with four stage combustion is reduced not by an equal difference but suddenly, so that the noise difference between the upper and lower curves is up to 8~12 dbs. The noise reducing effect is very obvious, thereby achieving an unexpected beneficial effect.

Embodiment 2

Figure 5:
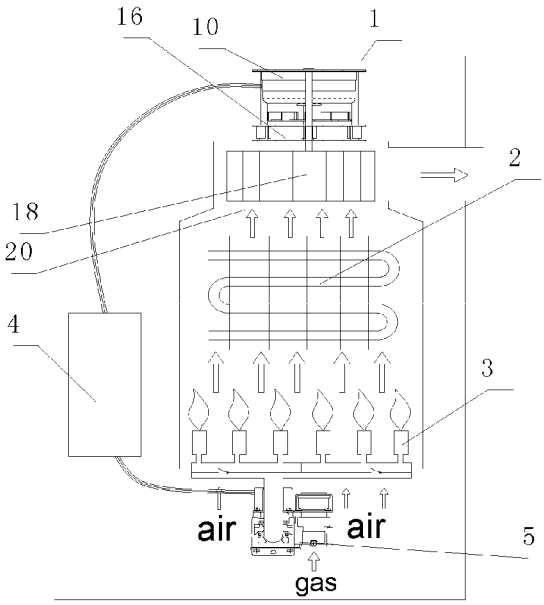
FIG. 5 is a structural diagram of a whole heater according to embodiment 2 of the invention.

As shown in FIG. 5, the technical solution of the embodiment 2 is substantially the same with that of the embodiment 1, with a difference in that, the combustion device 3 comprises two stage combustors. In the case that the user uses a small amount of water, it is possible to operate only one of the two stage combustors of the combustion device 3 so as to reduce the operation load of the gas instantaneous water heater and reduce the amount of air required for combustion, thereby further reducing the rotating speed of the blower 1 and achieving a more obvious noise reducing effect. Another difference from embodiment 1 lies in that, the air intake 20 of the blower 1 of the embodiment 2 faces straightly the flow direction of flue gas of the heat exchanger 2. Therefore, the flue gas enters the blower directly in a direction along which the flue gas flows out of the heat exchanger 2 and thus the flue gas meets a resistance which is lower that in the embodiment 1. Consequently, under the same condition, the rotating speed of the blower 1 of the embodiment 2 can be reduced further than that of the embodiment 1 and thus a better noise reducing effect could be achieved.

The invention could comprise other embodiments besides the above two ones. Any technical solution formed by adopting equivalent replacement or equivalent transformation shall fall within the protection scope of the invention.

What is claimed is:

1. A low-noise gas instantaneous water heater, comprising a combustion device, a heat exchanger and a blower; wherein the combustion device, the heat exchanger and the blower are arranged such that a combustion flue gas is discharged after passing sequentially through the heat exchanger and the blower;

and wherein the blower comprises a stepless speed regulating motor with a motor control panel and an impeller driven by the stepless speed regulating motor, and at least one thermal insulation device is arranged between the motor control panel and the combustion flue gas generated by the combustion device.

2. A low-noise gas instantaneous water heater according to claim 1, wherein a gas proportional valve is arranged in an air supply pipeline of the combustion device, a signal output end of the gas proportional valve is connected to a master controller, and a control signal output end of the master controller is connected to the motor control panel.

3. A low-noise gas instantaneous water heater according to claim 2, wherein the combustion device comprises at least two sets of controllable combustors in which a combustion can occur separately or simultaneously.

4. A low-noise gas instantaneous water heater according to claim 1, wherein the thermal insulation device is arranged between the impeller and the motor control panel.

5. A low-noise gas instantaneous water heater according to claim 1, wherein the thermal insulation device comprises at least one thermal insulation plate arranged on a shell of the blower with a thermal insulation gap provided therebetween.

6. A low-noise gas instantaneous water heater according to claim 1, wherein a heat dissipation fan is arranged between the thermal insulation device and the motor control panel.

7. A low-noise gas instantaneous water heater according to claim 1, wherein a stator and a rotor of the stepless speed regulating motor are arranged between the thermal insulation device and the motor control panel.

8. A low-noise gas instantaneous water heater according to claim 1, wherein the combustion flue gas of the combustion device enters an air intake of the blower in a direction along which the combustion flue gas flows out of the heat exchanger.

9. A low-noise gas instantaneous water heater according to claim 1, wherein the thermal insulation device comprises at least one thermal insulation plate arranged on a shell of the blower and fixedly connected with a fixing plate, and a thermal insulation gap is provided between the fixing plate and the thermal insulation plate.

* * * * *